US008977153B2

(12) United States Patent
Ogiyama et al.

(10) Patent No.: US 8,977,153 B2
(45) Date of Patent: Mar. 10, 2015

(54) IMAGE FORMING APPARATUS WHICH USES AN AC VOLTAGE AND/OR A DC VOLTAGE AT A TRANSFER NIP DEPENDING ON A SURFACE ROUGHNESS OF A RECORDING SHEET

(71) Applicants: Hiromi Ogiyama, Tokyo (JP); Tomokazu Takeuchi, Tokyo (JP); Yasunobu Shimizu, Kanagawa (JP); Kenji Sengoku, Kanagawa (JP); Hiroyoshi Haga, Ohta-ku (JP); Shinya Tanaka, Kanagawa (JP)

(72) Inventors: Hiromi Ogiyama, Tokyo (JP); Tomokazu Takeuchi, Tokyo (JP); Yasunobu Shimizu, Kanagawa (JP); Kenji Sengoku, Kanagawa (JP); Hiroyoshi Haga, Ohta-ku (JP); Shinya Tanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 43 days.

(21) Appl. No.: 13/680,629

(22) Filed: Nov. 19, 2012

(65) Prior Publication Data

US 2013/0136477 A1 May 30, 2013

(30) Foreign Application Priority Data

Nov. 30, 2011 (JP) ..... 2011-261768
Jul. 27, 2012 (JP) ..... 2012-167707

(51) Int. Cl.
*G03G 15/16* (2006.01)
*G03G 15/18* (2006.01)
*G03G 15/00* (2006.01)

(52) U.S. Cl.
CPC ..... *G03G 15/18* (2013.01); *G03G 15/1605* (2013.01); *G03G 15/1675* (2013.01); *G03G 15/5029* (2013.01)
USPC ..... 399/66

(58) Field of Classification Search
None
See application file for complete search history.

(56) References Cited

U.S. PATENT DOCUMENTS 4,528,937 A 7/1985 Kanno et al.
4,851,874 A 7/1989 Ogiyama
5,029,840 A 7/1991 Haga et al.

(Continued)

FOREIGN PATENT DOCUMENTS

JP 2000-019854 1/2000
JP 2006-267486 10/2006
JP 2011061678 * 3/2011

OTHER PUBLICATIONS

U.S. Appl. No. 13/477,724, filed May 22, 2012, Yasunobu Shimizu, et al.

(Continued)

*Primary Examiner* — Clayton E LaBalle
*Assistant Examiner* — Arlene Heredia Ocasio
(74) *Attorney, Agent, or Firm* — Oblon, McClelland, Maier & Neustadt, L.L.P.

(57) ABSTRACT

An image forming apparatus includes a controller and a transfer device including a power source to output a superimposed bias in which an AC voltage is superimposed on a DC voltage, a first electrode, a second electrode disposed opposite the first electrode with an image bearing member interposed therebetween to form a transfer electric field to transfer a toner image on the image bearing member to a recording medium. The controller including a CPU adjusts the transfer electric field and a transfer speed. One of the first electrode and the second electrode is connected to the power source, and the other is grounded. The controller adjusts the transfer speed such that in a case in which an oscillating electric field of the transfer electric field is strong, a maximum transfer speed is slower than the maximum transfer speed in a case in which the oscillating electric field is weak.

8 Claims, 10 Drawing Sheets

(56) References Cited

U.S. PATENT DOCUMENTS

| | | | |
|---|---|---|---|
| 5,483,330 | A | 1/1996 | Ogiyama et al. |
| 5,991,570 | A | 11/1999 | Haga et al. |
| 2001/0031159 | A1 | 10/2001 | Ogiyama et al. |
| 2002/0034406 | A1 | 3/2002 | Kawagoe et al. |
| 2003/0016968 | A1 | 1/2003 | Takahashi et al. |
| 2003/0026625 | A1 | 2/2003 | Tamiya et al. |
| 2003/0035660 | A1 | 2/2003 | Sugino et al. |
| 2003/0118359 | A1 | 6/2003 | Ogiyama et al. |
| 2003/0219287 | A1 | 11/2003 | Ogiyama et al. |
| 2004/0105692 | A1 | 6/2004 | Tamiya et al. |
| 2004/0136760 | A1 | 7/2004 | Yoshida et al. |
| 2005/0013636 | A1 | 1/2005 | Sawai et al. |
| 2005/0047816 | A1 | 3/2005 | Uchida et al. |
| 2005/0147424 | A1 | 7/2005 | Kato et al. |
| 2006/0127116 | A1 | 6/2006 | Ogiyama et al. |
| 2006/0239722 | A1 | 10/2006 | Tanaka et al. |
| 2006/0245794 | A1 | 11/2006 | Honda et al. |
| 2007/0134014 | A1 | 6/2007 | Kato et al. |
| 2007/0224528 | A1 | 9/2007 | Yamashita et al. |
| 2007/0258737 | A1 | 11/2007 | Ogiyama et al. |
| 2008/0095553 | A1 | 4/2008 | Tanaka et al. |
| 2008/0118286 | A1 | 5/2008 | Yamashita et al. |
| 2008/0138132 | A1 | 6/2008 | Yamashita et al. |
| 2008/0232867 | A1 | 9/2008 | Minbu et al. |
| 2009/0196665 | A1 | 8/2009 | Tanaka et al. |
| 2009/0279930 | A1 | 11/2009 | Kabata et al. |
| 2009/0285613 | A1 | 11/2009 | Nakai et al. |
| 2009/0290919 | A1 | 11/2009 | Tanaka et al. |
| 2009/0304423 | A1 | 12/2009 | Ozaki et al. |
| 2009/0311014 | A1 | 12/2009 | Tanaka et al. |
| 2010/0034560 | A1 | 2/2010 | Tanaka et al. |
| 2010/0040386 | A1 | 2/2010 | Mizutani et al. |
| 2010/0054829 | A1 | 3/2010 | Iio et al. |
| 2010/0080631 | A1 | 4/2010 | Ogiyama et al. |
| 2010/0098446 | A1 | 4/2010 | Ishikawa et al. |
| 2010/0142985 | A1 | 6/2010 | Minbe et al. |
| 2010/0183972 | A1 | 7/2010 | Hasegawa et al. |
| 2010/0209143 | A1 | 8/2010 | Nakai et al. |
| 2010/0221029 | A1 | 9/2010 | Minbu et al. |
| 2010/0239309 | A1 | 9/2010 | Tanaka et al. |
| 2010/0310291 | A1 | 12/2010 | Tanaka et al. |
| 2011/0008088 | A1 | 1/2011 | Nakai et al. |
| 2011/0038656 | A1 | 2/2011 | Hasegawa et al. |
| 2011/0052286 | A1 | 3/2011 | Urayama et al. |
| 2011/0064487 | A1 | 3/2011 | Ichihashi et al. |
| 2011/0158690 | A1 | 6/2011 | Mimbu et al. |
| 2011/0181116 | A1 | 7/2011 | Takeuchi et al. |
| 2011/0206399 | A1 | 8/2011 | Fujita et al. |
| 2011/0286759 | A1 | 11/2011 | Ichihashi et al. |
| 2011/0293312 | A1 | 12/2011 | Mimbu et al. |
| 2012/0008991 | A1 | 1/2012 | Shimizu |
| 2012/0045237 | A1* | 2/2012 | Aoki et al. ..... 399/66 |
| 2012/0045259 | A1* | 2/2012 | Nakamura et al. ..... 399/314 |
| 2012/0057912 | A1 | 3/2012 | Hasegawa et al. |
| 2012/0060753 | A1 | 3/2012 | Tanaka et al. |
| 2012/0063809 | A1 | 3/2012 | Tanaka et al. |
| 2012/0063825 | A1 | 3/2012 | Hasegawa et al. |
| 2012/0195662 | A1 | 8/2012 | Hasegawa et al. |
| 2012/0213536 | A1* | 8/2012 | Takeuchi ..... 399/45 |
| 2012/0224879 | A1 | 9/2012 | Fujita et al. |
| 2012/0230715 | A1* | 9/2012 | Ogino et al. ..... 399/66 |
| 2012/0237234 | A1* | 9/2012 | Sugimoto et al. ..... 399/50 |
| 2012/0237260 | A1 | 9/2012 | Sengoku et al. |
| 2012/0237271 | A1 | 9/2012 | Sengoku et al. |
| 2012/0315058 | A1* | 12/2012 | Shimizu et al. ..... 399/66 |
| 2013/0136477 | A1* | 5/2013 | Ogiyama et al. ..... 399/66 |

OTHER PUBLICATIONS

U.S. Appl. No. 13/485,151, filed May 31, 2012, Yasunobu Shimizu, et al.
U.S. Appl. No. 13/483,536, filed May 30, 2012, Kenji Sengoku, et al.
U.S. Appl. No. 13/530,555, filed Jun. 22, 2012, Tomokazu Takeuchi, et al.
U.S. Appl. No. 13/526,894, filed Jun. 19, 2012, Tomokazu Takeuchi, et al.
U.S. Appl. No. 13/472,743, filed May 16, 2012, Junpei Fujita, et al.
U.S. Appl. No. 13/527,153, filed Jun. 19, 2012, Junpei Fujita, et al.
U.S. Appl. No. 13/525,681, filed Jun. 18, 2012, Naomi Sugimoto, et al.
U.S. Appl. No. 13/472,897, filed May 16, 2012, Hiromi Ogiyama.
U.S. Appl. No. 13/541,211, filed Jul. 3, 2012, Hiromi Ogiyama, et al.

* cited by examiner

IMAGE FORMING APPARATUS WHICH USES AN AC VOLTAGE AND/OR A DC VOLTAGE AT A TRANSFER NIP DEPENDING ON A SURFACE ROUGHNESS OF A RECORDING SHEET

CROSS-REFERENCE TO RELATED APPLICATIONS

This patent application is based on and claims priority pursuant to 35 U.S.C. §119 from Japanese Patent Application Nos. 2011-261768, filed on Nov. 30, 2011, and 2012-167707, filed on Jul. 27, 2012, both in the Japan Patent Office, which are hereby incorporated herein by reference in their entirety.

BACKGROUND OF THE INVENTION

1. Field of the Invention

Exemplary aspects of the present invention generally relate to an image forming apparatus, such as a copier, a facsimile machine, a printer, or a multi-functional system including a combination thereof, and more particularly to, a transfer device employed in the image forming apparatus.

2. Description of the Related Art

Known image forming apparatuses, such as copiers, facsimile machines, printers, or multifunction printers having at least one of copying, printing, scanning, and facsimile capabilities, typically form an image on a recording medium according to image data. Thus, for example, a charger uniformly charges a surface of an image bearing member (which may, for example, be a photosensitive drum); an optical writer projects a light beam onto the charged surface of the image bearing member to form an electrostatic latent image on the image bearing member according to the image data; a developing device supplies toner to the electrostatic latent image formed on the image bearing member to render the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

An electrostatic transfer method is widely employed in image forming apparatuses to transfer the toner image formed on the image bearing member onto an intermediate transfer member or directly onto a recording medium. In such electrostatic transfer method, a transfer bias having a polarity opposite that of the toner is supplied to form a transfer electric field which enables toner to move from an image bearing member to the recording medium or to the intermediate transfer member.

The above-described transfer method can be applied to single-color image formation in which a toner image is transferred from a single image bearing member and to multiple-color image formation in which a plurality of toner images are transferred to the intermediate transfer member one atop the other to form a composite toner image, and the composite toner image is then transferred onto a recording medium.

A variety of recording media sheets such as textured or embossed paper having a rough surface have come on the market. A recording medium having a relatively large embossed groove depth or having a low smoothness has a rough surface. When transferring a toner image onto the rough surface of the recording medium, there is a gap between the image bearing member and a recessed portion of the surface of the recording medium, and the size of the gap varies between the recessed portions. As a result, the toner is not transferred sufficiently onto the recessed portions, causing low transferability of toner and hence resulting in image defects such as dropouts and blank spots.

In order to prevent improper transfer of toner, JP-2000-19854-A proposes to detect the gap formed between the recessed portions of the recording medium and the image bearing member at a transfer nip where the toner image is transferred onto the recording medium. After detecting the gap, an oscillating electric field is applied to the transfer nip, thereby moving the toner back and forth in the transfer nip. In this configuration, a frequency of toner contacting the recessed portions is increased, hence increasing transferability of toner.

When forming the oscillating electric field, an absolute value of a peak voltage exceeds a voltage with a steady electric field. As a result, leakage occurs at places such as an end portion of a transfer device (for example, a transfer roller) constituting the transfer nip, an insulating member that insulates from a housing an electrode to which a high voltage is applied, inside a high voltage power source for outputting a high voltage, between the housing and a high-voltage power line and a connector connecting the high voltage power source and the electrode. The leakage increases power consumption, hence increasing the running cost of the image forming apparatus. Moreover, the leakage adversely affects other electronic devices.

In view of the above, there is thus an unsolved need for an image forming apparatus capable of suppressing leakage when transferring toner using an oscillating electric field.

SUMMARY OF THE INVENTION

In view of the foregoing, in an aspect of this disclosure, there is provided an improved image forming apparatus including an image bearing member, a transfer device, and a controller. The image bearing member bears a toner image on an image bearing surface thereof. The transfer device transfers the toner image on the image bearing surface onto a recording medium using a transfer electric field. The controller includes a CPU to change the transfer electric field and a transfer speed for transferring the toner image from the image bearing member onto the recording medium. The transfer device includes a power source, a first electrode, and a second electrode. The power source outputs a superimposed bias in which an AC voltage is superimposed on a DC voltage. The second electrode is disposed opposite the first electrode with the image bearing member interposed therebetween to form the transfer electric field to transfer toner on the toner image on the image bearing member onto the recording medium. One of the first electrode and the second electrode is connected to the power source, and another of the first electrode and the second electrode is grounded. The transfer electric field includes an oscillating electric field, and the controller adjusts the transfer speed such that in a case in which the oscillating electric field is strong a maximum transfer speed is slower than the maximum transfer speed in a case in which the oscillating electric field is weak.

According to another aspect, image forming apparatus including an image bearing member, a transfer device, and a controller. The image bearing member bears a toner image on a surface thereof. The transfer device transfers the toner image on the surface of the image bearing member onto a recording medium using a transfer electric field. The controller includes a CPU to change the transfer electric field and a transfer speed for transferring the toner image from the image bearing member onto the recording medium. The transfer device includes a power source, a first electrode, and a second electrode. The power source outputs a superimposed bias in which an AC voltage is superimposed on a DC voltage. The second electrode is disposed opposite the first electrode with the image bearing member interposed therebetween to form the transfer electric field to transfer toner on the toner image on the image bearing member onto the recording medium. One of the first electrode and the second electrode is connected to the power source, and another of the first electrode and the second electrode is grounded. The transfer electric field includes an oscillating electric field and a steady electric field, and the controller adjusts the transfer speed such that in a case in which the transfer electric field is the oscillating electric field, a maximum transfer speed is slower than the maximum transfer speed in a case in which the transfer electric field is the steady electric field.

According to another aspect, an image forming apparatus includes an image bearing member, a transfer device, and a controller. The image bearing member bears a toner image on a surface thereof. The transfer device transfers the toner image on the surface of the image bearing member onto a recording medium using a transfer electric field. The transfer device includes a first DC power source, a superimposed bias power source, a first electrode, and a second electrode. The first DC power source outputs a DC voltage to form a steady electric field. The superimposed bias power source includes a second DC power source to output a superimposed bias in which an AC voltage is superimposed on a DC voltage to form an oscillating electric field. The second electrode is disposed opposite the first electrode with the image bearing member interposed therebetween to form the transfer electric field to transfer toner on the toner image on the image bearing member onto the recording medium. The controller include a CPU to switch the transfer electric field between the steady electric field and the oscillating electric field and to change a transfer speed for transferring the toner image from the image bearing member onto the recording medium. One of the first electrode and the second electrode is connected switchably to one of the first DC power source and the superimposed bias power source, and another of the first electrode and the second electrode is grounded. In a case in which an absolute value of a maximum output voltage of the first DC power source is greater than that of the second DC power source, the maximum transfer speed using the superimposed bias power source is slower than the maximum transfer speed using the first DC power source.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF THE INVENTION

Figure 1A:
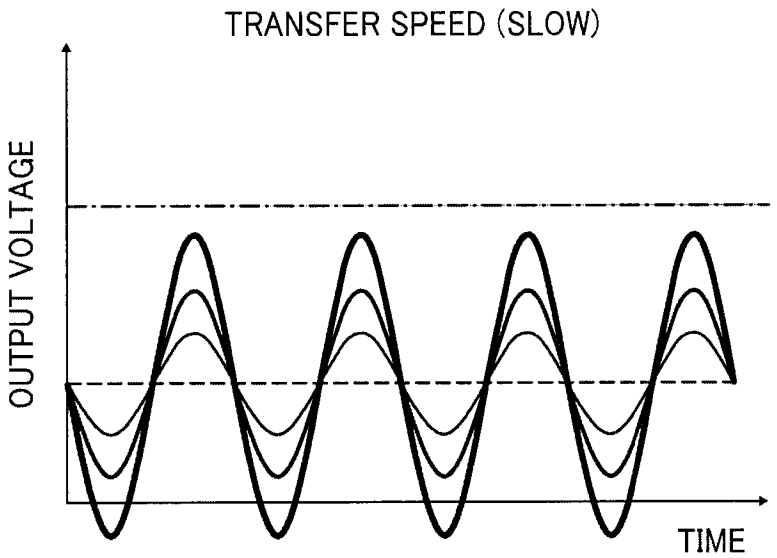
FIG. 1A is an output waveform of a superimposed bias power source which forms a transfer electric field between electrodes by supplying one of the electrodes with a superimposed bias consisting of an alternating current (AC) voltage superimposed on a direct current (DC) voltage when a transfer speed is slow.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, a description is provided of an image forming apparatus according to an aspect of this disclosure.

According to an illustrative embodiment of the present invention, when using an oscillating electric field leakage is prevented by associating an intensity of an oscillating electric field serving as a transfer electric field with a transfer speed at which toner is transferred onto a recording medium. The detailed description is provided below.

Figure 1B:
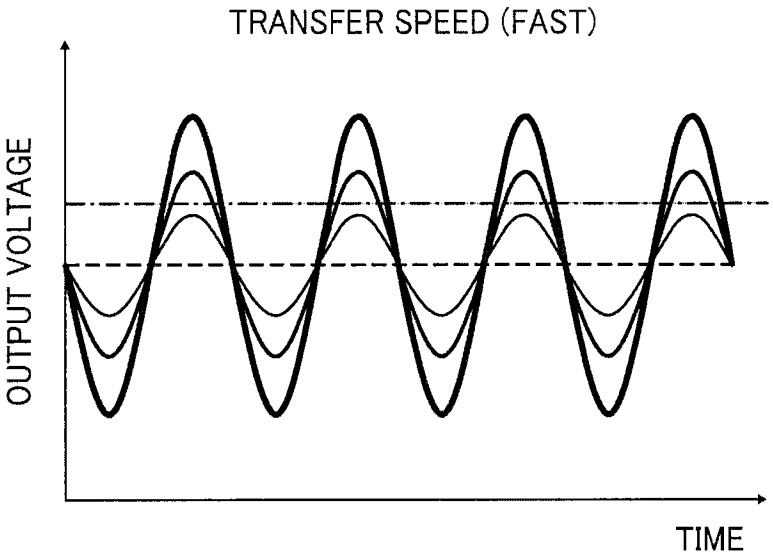
FIG. 1B is an output waveform of the superimposed bias power source of FIG. 1A when the transfer speed is fast.

FIGS. 1A and 1B show waveforms of an output voltage from a superimposed bias power source 110 (shown in FIG. 4) that applies a bias to one of two electrodes (metal cored bars) between which a transfer belt 31 serving as an image bearing member and a recording medium are interposed, and a transfer electric field is formed.

The waveform of the output voltage from the superimposed bias power source 110 is observed using an oscilloscope. The superimposed bias power source 110 outputs a superimposed bias in which an alternating current (AC) voltage output from an AC power source is superimposed on a direct current (DC) voltage output from a DC power source. Numerical values are omitted herein because, depending on the configuration and the resistance of devices, an optimum voltage for forming an image and a leakage limit vary. Even when the configuration and the resistance of parts and devices change, results shown in FIGS. 1A and 1B are obtained steadily.

It is to be noted that in FIGS. 1A and 1B a transfer direction of voltage in which the toner on the transfer belt 31 serving as the image bearing member is transferred onto a recording medium is indicated as a positive direction. However, the transfer direction may be opposite the electric charge.

Figure 8:
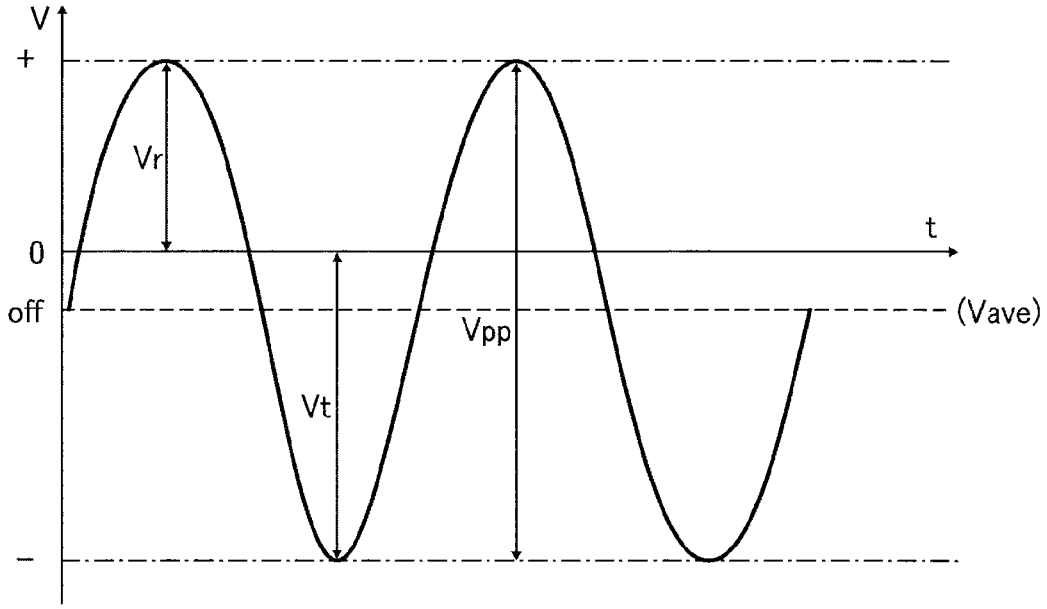
FIG. 8 is an example of a waveform of the superimposed bias.

FIG. 8 shows an example of a waveform of the superimposed bias output from the superimposed bias power source 110 in which an alternating current (AC) voltage is superimposed on a direct current (DC) voltage.

In FIG. 8, an offset voltage Voff is a value of a DC component of the superimposed bias. A peak-to-peak voltage Vpp is a peak-to-peak voltage of an AC component of the superimposed bias. According to the present illustrative embodiment, the superimposed bias consists of a superimposed voltage in which the offset voltage Voff and the peak-to-peak voltage Vpp are superimposed, and a time-averaged value (Vave) of the superimposed bias coincides with the offset voltage Voff. In the present illustrative embodiment, the superimposed bias has a sinusoidal waveform which includes a peak at a positive side and a peak at a negative side.

Figure 7:
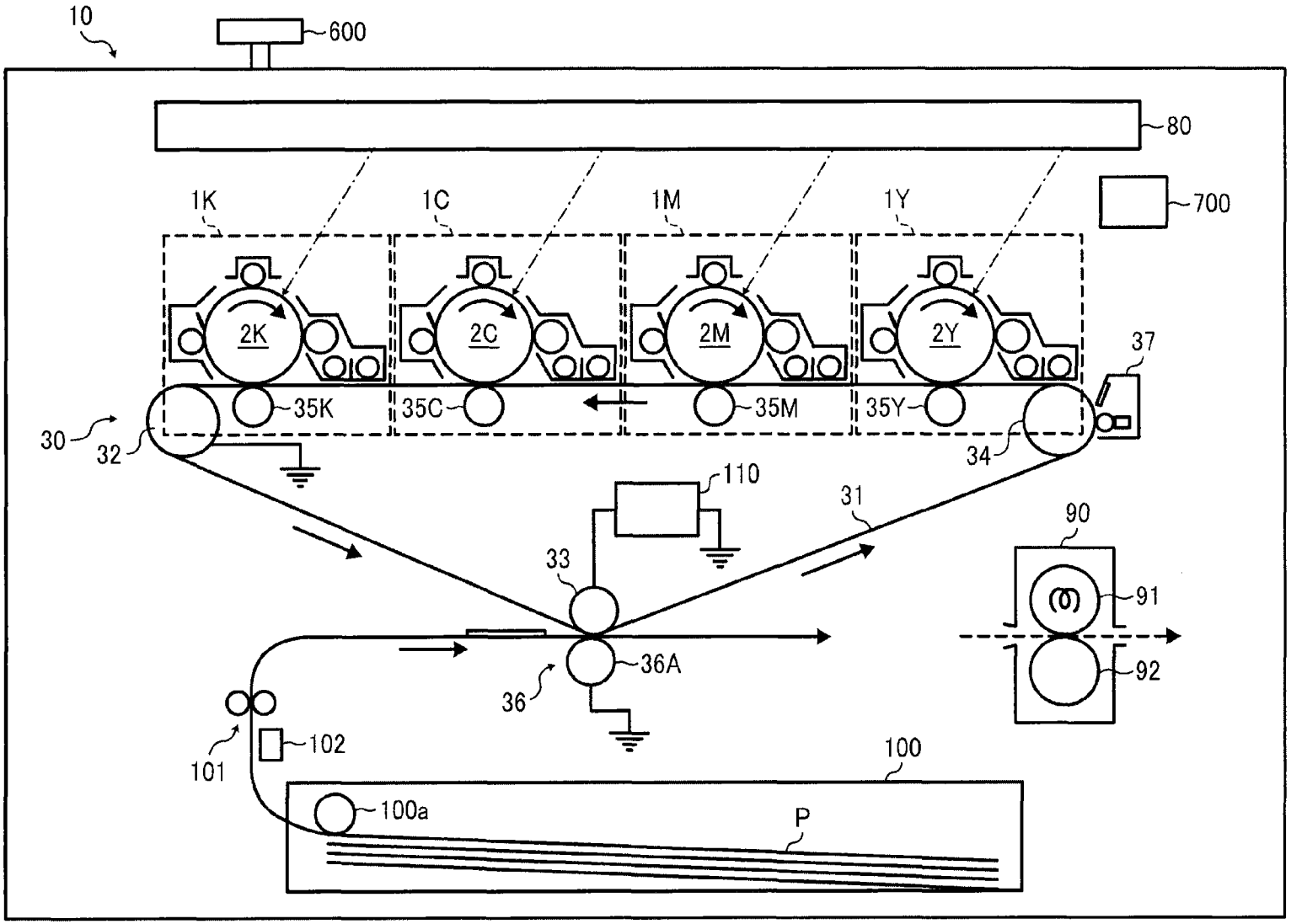
FIG. 7 is a schematic diagram illustrating an image forming apparatus employing the transfer device of the illustrative embodiment of the present invention.

In FIG. 8, a reference sign Vt refers to one of the two peak values, that is, the peak value (i.e. the negative peak value in the present example) for moving the toner from a transfer belt side (i.e. transfer belt 31 shown in FIG. 7) to the recording medium side in a secondary transfer nip. The secondary transfer nip or simply a nip is a place where a secondary transfer auxiliary roller 33 and a secondary transfer roller 36 meet and press against each other via the transfer belt 31 as shown in FIG. 7. This peak value is hereinafter referred to as a transfer peak value Vt.

A reference sign Vr refers to another of two peak values, that is, the peak value (i.e. the positive peak value in the present example) for returning the toner from the recording medium side to the belt side. This peak value is hereinafter referred to as a returning peak value Vr.

If the superimposed bias including the DC component is applied to adjust the offset voltage Voff, which is the time-averaged value of the superimposed bias, to the same polarity as the toner (here, negative polarity), the toner is enabled to move from the belt side toward the recording medium side relatively while the toner moves back and forth between the belt side and the recording medium side. Accordingly, the toner can be transferred onto the recording medium.

According to the present illustrative embodiment, the AC voltage having a sine wave is used. Alternatively, as illustrated in FIG. 9 (for a low-duty waveform), an AC voltage having a rectangular wave may be used.

Figure 9:
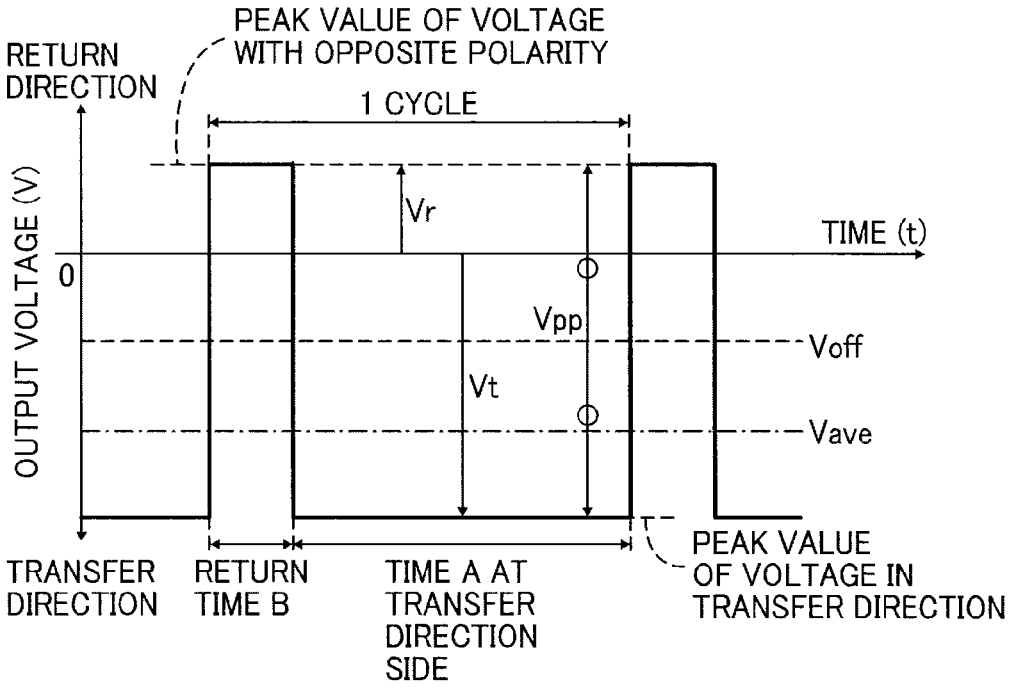
FIG. 9 is another example of the waveform of the superimposed bias.

As illustrated in FIG. 9, a time (in the present example, at the negative side) for transferring the toner having the AC component from the belt side to the recording medium side can be different from a time (in the present example, the positive side) for returning the toner from the recording medium side to the belt side.

According to the present illustrative embodiment, the time for transferring the toner from the belt side to the recording medium side is longer than the time for returning the toner from the recording medium side to the belt side. Accordingly, the time-averaged value (Vave) of the AC component of the superimposed bias is adjusted to the polarity that transfers the toner image from the belt side to the recording medium side. With this configuration, the AC component of the superimposed bias is adjusted towards the transfer direction side beyond the DC component (Voff) of the superimposed bias.

Figure 2A:
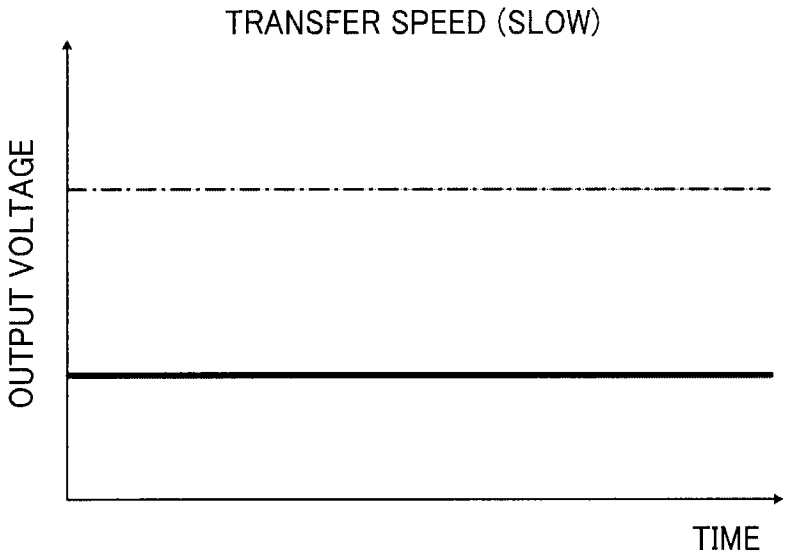
FIG. 2A is an output waveform of a DC power source which forms the transfer electric field between the electrodes by supplying one of the electrodes with only a DC voltage when the transfer speed is slow.
Figure 2B:
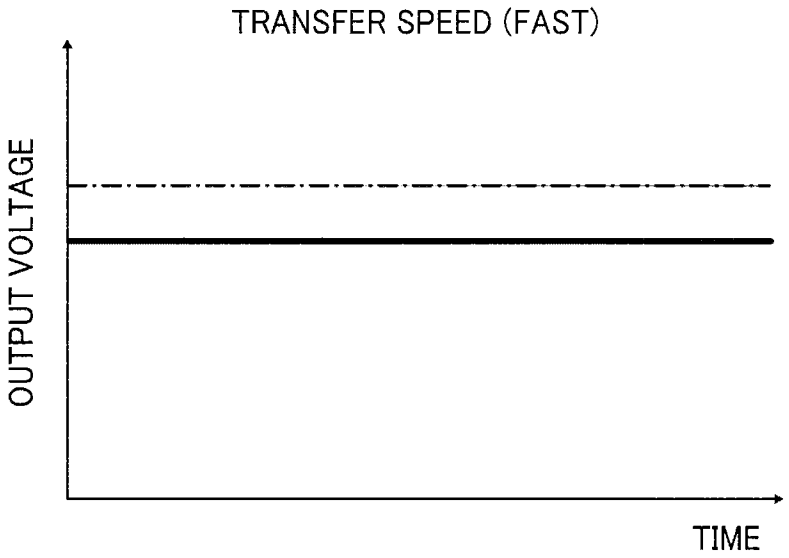
FIG. 2B is an output waveform of the DC power source of FIG. 2A when the transfer speed is fast.

FIGS. 2A and 2B schematically show waveforms of the output voltage from a DC power source of the superimposed bias power source 110. FIG. 2A shows the waveforms of the output voltage from the DC power source when the transfer speed is slow. FIG. 2B shows the waveforms of the output voltage from the DC power source when the transfer speed is fast. The output voltages are observed using an oscilloscope.

It is to be noted that in FIGS. 2A and 2B the transfer direction of voltage in which the toner on the image bearing member, i.e. the transfer belt 31 is transferred onto a recording medium is a positive direction. However, the transfer direction of voltage does not necessarily coincide with the electric charge. The transfer direction of voltage may be opposite the electric charge.

Figure 3A:
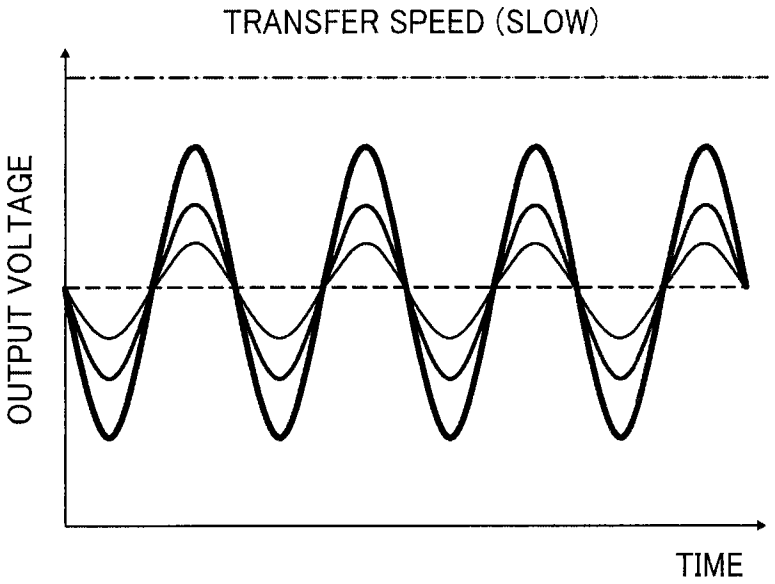
FIG. 3A is an output waveform of an AC power source of the superimposed power source of FIG. 1A which forms the transfer electric field between the electrodes by supplying one of the electrodes with only an AC voltage when the transfer speed is slow.
Figure 3B:
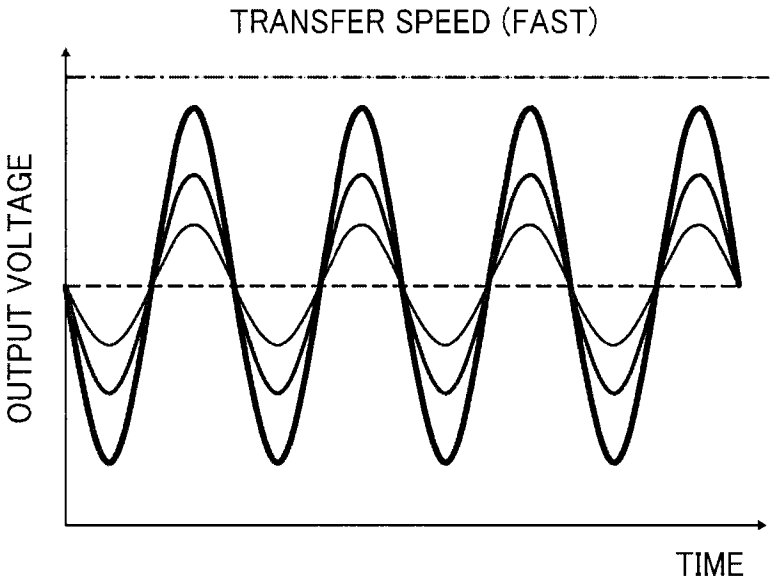
FIG. 3B is an output waveform of the AC power source of FIG. 3A when the transfer speed is fast.
Figure 3B:
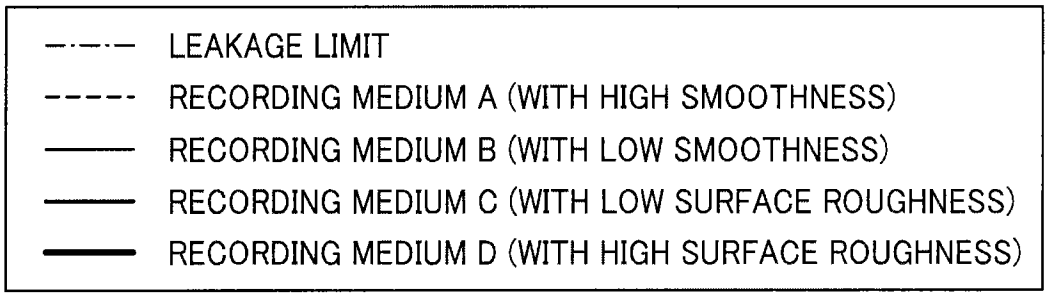

FIGS. 3A and 3B schematically show waveforms of an output voltage from the AC power source of the superimposed bias power source 110. FIG. 3A shows the waveforms of the output voltage from the AC power source when the transfer speed is slow. FIG. 3B shows the waveforms of the output voltage from the AC power source when the transfer speed is fast. The output voltages are observed using an oscilloscope.

It is to be noted that in FIGS. 3A and 3B the transfer direction of voltage in which the toner on the image bearing member, i.e. the transfer belt 31 is transferred onto a recording medium is a positive direction. However, the transfer direction of voltage does not necessarily coincide with electric charge. The transfer direction of voltage may be opposite the electric charge.

FIGS. 1A and 1B show a sum of voltages shown in FIGS. 2A and 3A, and FIGS. 2B and 3B, respectively.

FIGS. 1A, 2A, and 3A show results when the transfer speed is slow. FIGS. 1B, 2B, and 3B show results when the transfer speed is fast.

FIGS. 1A through 3B illustrate optimum waveforms for different types of recording media. In FIGS. 1A through 3B, RECORDING MEDIUM A refers to a recording medium having high smoothness, that is, a surface with smoothness of greater than 40 s, measured with Oken-type smoothness tester J.Tappi No. 5. RECORDING MEDIUM B refers to a recording medium having low smoothness, that is, a surface with smoothness of 40 s or less. RECORDING MEDIUM C refers to a recording medium having low surface roughness, that is, a surface with smoothness of 40 s or less and a maximum groove (recessed portion) depth of equal to or greater than 60 μm but less than 100 μm. RECORDING MEDIUM D refers to a recording medium having high surface roughness, that is, a surface with smoothness of 40 s or less and a maximum groove (recessed portion) depth of equal to or greater than 100 μm.

Surface conditions of the recording media sheets were measured with a roughness meter, SURFCOM 1400D manufactured by Tokyo Seimitsu Co., Ltd. As for measurement points, a surface of each of the recording media was observed with a microscope, and five test regions were selected at random from the entire surface. For each of the regions, a maximum profile height Pt (according to JIS B 0601: 2001) of a profile curve was measured under the condition of using an evaluation length of approximately 20 mm and a reference length of approximately 20 mm. Then, three highest values were selected from the thus obtained five values of the maximum profile height Pt, and the mean value of the three highest values was calculated. The above-described operation was performed on three recording sheets of the same type, and the mean of the above-described mean values of the three recording sheets was calculated as a maximum recess depth D.

A double-dot-dash line shows a threshold voltage (leakage limit voltage) above which leakage may occur. If an absolute value exceeds the leakage limit voltage, leakage may occur. More specifically, if the absolute value departs from an origin in either the positive or the negative directions, leakage may occur. In the area toward the origin, leakage is less likely to occur.

It is to be noted that FIGS. 1A through 3B show results when the image forming apparatus is in a low-temperature, low-humidity environment. In a low-temperature, low-humidity environment, resistance of the recording medium and devices that constitute the transfer nip rises. As a result, the absolute value of the transfer voltage rises, and hence exceeds the leakage limit voltage easily.

As shown in FIG. 1A, when the transfer speed is relatively slow, the voltage does not exceed the leakage limit. By contrast, as shown in FIG. 1B, when the transfer speed is relatively fast, the voltage exceeds the leakage limit when using a recording medium with low surface roughness as well as a recording medium with high surface roughness.

As understood from FIGS. 1A and 1B, in order to prevent leakage, when using a recording medium with high surface roughness, the transfer speed is adjusted to be slow. When using a recording medium with high smoothness and low smoothness, the transfer speed can be either slow or fast.

The reason for reducing the transfer speed to prevent leakage is as follows.

As shown in FIGS. 1A, 1B, 3A, and 3B, the larger the groove depth of the recessed portion of the surface of the recording medium, the greater the gap between the surface of the recording medium and the image bearing member, i.e. the transfer belt 31 in the transfer nip. For example, as the groove depth of the recessed portion increases in the order of the recording medium A through the recording medium D in FIGS. 1A, 1B, 3A, and 3B, the size of the gap increases, accordingly. As a result, a greater AC voltage is required as the size of the gap increases.

As the transfer speed increases, the optimum AC voltage increases slightly. In a case in which the transfer speed increases approximately twice, for example, the optimum AC voltage increases approximately 1.0 to 1.2 times, which is not a significant change. In other words, if the transfer speed increases approximately twice, the same AC voltage may be applied without degrading transferability of toner.

Figure 1B:
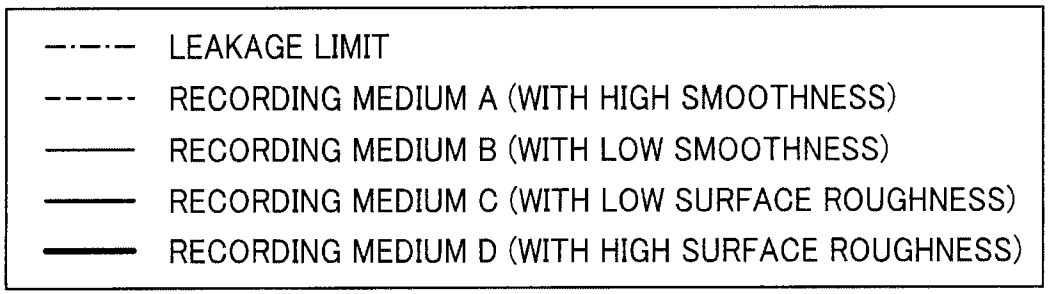
Figure 2B:
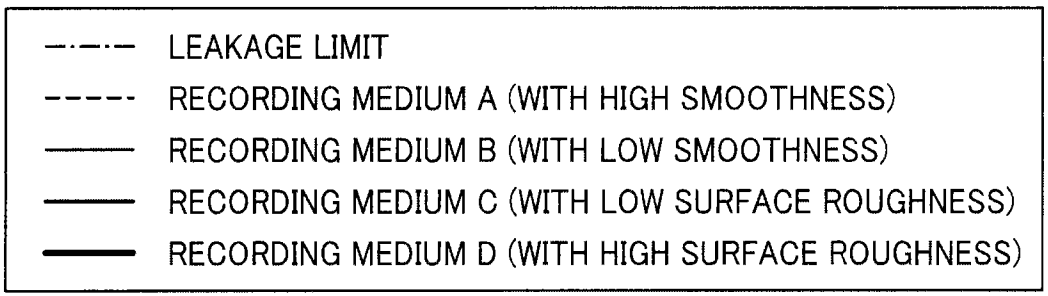

As for the DC voltage, as shown in FIGS. 1 and 2, even when the groove depth of the recessed portion of the surface of the recording medium increases such as from the recording medium A through D, the levels of the DC voltage overlap with one another, that is, the DC voltage is the same.

This indicates that even when the recording medium has a surface with low smoothness or high surface roughness, the transfer electric field at a substantially flat portion contacting the image bearing member in the transfer nip is the same as the transfer electric field for the recording medium having a surface with high smoothness, the entire of which contacts the image bearing member. For the recording medium having a surface with high smoothness, a high AC voltage is not necessary (in the present illustrative embodiment, 0V) because the size of the recessed portions is small. This means that the oscillating electric field does not contribute to the transferability of toner at the flat portion of the recording medium contacting the image bearing member.

It is to be noted that the frequency of the alternating current, which is one of the conditions to obtain the results described above, has a frequency having several cycles in the transfer nip.

As shown in FIGS. 2A and 2B, as the transfer speed increases, the optimum DC voltage also increases. For example, as the transfer speed increases twice, the optimum DC voltage increases approximately 1.6 times to 2.0 times.

In the case of the steady electric field, the transfer electric field to be applied to the toner in the transfer nip is formed between the surface of the image bearing member, i.e. the transfer belt 31 and the surface of the recording medium with the toner layer therebetween. Thus, regardless of the resistance of the recording medium and devices constituting the transfer nip, the transfer electric field depends on the concentration of the electric charge between the recording medium and the surface of the image bearing member.

It is known that in an image forming apparatus in which the transfer current supplied from a high-voltage power source reaches the surface of the image bearing member without leakage and interference, when the high-voltage power source employs a constant current power source, the optimum transfer current becomes constant regardless of the resistance of the recording medium and the devices constituting the transfer nip, thereby stabilizing the transferability.

In a case in which the transfer speed changes, the concentration of the electric charge in the transfer nip becomes constant by making the transfer current proportional to the transfer speed, thereby stabilizing the transferability. In other words, when the transfer speed is twice as fast, the transfer current also doubles.

If the resistance of the recording medium and the devices constituting the transfer nip follows Ohm's law, the voltage is proportional to the current. However, many of the recording medium and the devices constituting the transfer nip are voltage-dependent, that is, as the voltage increases, the resistance drops. This is the reason why when the transfer speed is twice as fast, the optimum DC transfer voltage increases 1.6 to 2.0 times.

In a case in which the transfer speed increases, although an amount of increase in the optimum AC voltage is small, the optimum DC transfer voltage increases significantly due to the proportional relationship, causing the peak of the transfer voltage to exceed the leakage limit. Therefore, the leakage can be prevented by reducing the transfer speed.

In view of the above, in order to reduce the transfer speed to prevent the transfer voltage from exceeding the leakage limit, a recording medium having a rough surface such as having high surface roughness and low surface roughness is not used in a case in which the transfer speed is relatively fast.

For example, based on conditions of the surface of the recording medium detected by a surface condition detector 102, the transfer speed is adjusted. More specifically, when the transfer speed is fast and the recording medium has a rough surface (including high surface roughness and low surface roughness), it is notified that such a recording medium cannot be used. In a case in which the recording medium has high surface roughness, the transfer speed is set slow. By contrast, the transfer speed is set fast for the recording medium with either high smoothness or low smoothness.

Furthermore, not only changing the transfer speed, but also a maximum peak voltage that the superimposed power source can output is adjusted below the leakage limit voltage. More specifically, when the transfer speed is relatively slow, the DC power source of the superimposed power source can output reliably a proper DC voltage at the maximum output level of the DC power source. However, when the transfer speed is relatively fast, the maximum output level of the DC power source needs to be reduced to the level at which the proper DC voltage can no longer be output.

In this configuration, when the transfer speed is relatively slow, the superimposed power source can accommodate all types of recording media such as ones having high smoothness, low smoothness, high surface roughness, and low surface roughness, thereby forming a good image on these recording media. However, when the transfer speed is relatively fast, the DC voltage becomes insufficient, causing improper transfer of toner on all types of the recording media.

In view of the above, when the transfer speed is fast, a separate DC power source, different from the one employed in the superimposed power source, is employed to output an optimum DC voltage at fast transfer speed so that the recording medium with high smoothness can be used. A relay or a switch is used to switch between these DC power sources.

As described above, FIGS. 1A through 3B show the output waveforms of the power source in low-temperature, low-humidity environment in which the resistance of the recording medium and the devices constituting the transfer nip increases and the optimum voltage increases, as compared with the resistance at room temperature and normal humidity environment. More specifically, in a case in which the devices constituting the transfer nip utilize an ion-conductive material, at temperature of 10° C., humidity 15%, the optimum voltage often increases at least twice or approximately three times the voltage at temperature of 23° C., humidity 50%. Similar to the case in which the transfer speed changes, the optimum voltage changes such that the DC voltage is greater than the AC voltage due to the change in the environment.

Even when the maximum voltage that the superimposed power source can output is reduced to the level less than or equal to the leakage limit voltage, the superimposed power source can still output an optimum voltage at fast transfer speed at room temperature and normal humidity.

In view of the above, even when the transfer speed is fast at room temperature and normal humidity, the superimposed power source is used. When the transfer speed is fast at low-temperature, low-humidity environment, the superimposed power source may not be used.

With reference to FIG. 7, a description is provided of an image forming apparatus employing the transfer device according to an illustrative embodiment of the present invention. FIG. 7 is a schematic diagram illustrating a color printer as an example of the image forming apparatus.

As illustrated in FIG. 7, an image forming apparatus 10 is a color printer capable of producing a multiple-color image. The image forming apparatus 10 includes an image forming station including a plurality of image forming units 1Y, 1M, 1C, and 1K arranged in tandem along the transfer belt 31 serving as the intermediate transfer member.

The image forming apparatus 10 includes a transfer device 30 including the transfer belt 31, the image forming station including the plurality of image forming units 1Y, 1M, 1C, and 1K, a sheet feed unit 100, and an image writing unit 80. The transfer device 30 is disposed substantially at the center of the image forming apparatus 10 in the height direction thereof. The transfer belt 31 is entrained about a plurality of rollers 32, 33, and 34. The sheet feed unit 100 is disposed substantially below the image forming units 1Y, 1M, 1C, and 1K of the image forming station. The image writing unit 80 is disposed substantially above the image forming units 1Y, 1M, 1C, and 1K. The image forming apparatus 10 includes at least one of a control panel 600 and the surface condition detector 102. A user may input a type or a roughness value of a recording medium through the control panel 600. Alternatively, the surface condition detector 102 is provided in a sheet delivery path downstream from the sheet feed unit 100 to detect optically at least one of roughness or smoothness of the recording medium.

It is to be noted that suffixes Y, C, M, and K denote the colors yellow, cyan, magenta, and black, respectively. To simplify the description, the reference characters Y, M, C, and K indicating colors are omitted herein unless otherwise specified.

The image forming units 1Y, 1M, 1C, and 1K of the image forming station all have the same configuration as all the others, differing only in the color of toner employed. The image forming units 1Y, 1M, 1C, and 1K include photosensitive drums 2Y, 2M, 2C, and 2K serving as image bearing members, respectively. Imaging devices such as a charger, a developing device, and a cleaning device are disposed around each of the photosensitive drums 2Y, 2M, 2C, and 2K.

The image forming units 1Y, 1M, 1C, and 1K are detachably attachable relative to a main body of the image forming apparatus 10. Upon maintenance or the like, the image forming units 1Y, 1M, 1C, and 1K can be removed from the main body of the image forming apparatus 10.

The transfer device 30 is disposed in the image forming station and includes the transfer belt 31, primary transfer rollers 35Y, 35M, 35C, and 35K, a secondary transfer device 36 including a secondary transfer roller 36A, and a secondary transfer auxiliary roller (repulsive force roller) 33. The transfer belt 31 is formed in to a loop, entrained about the plurality of rollers 32, 33, and 34, and rotated in the direction indicated by hollow arrows in FIG. 7. The roller 33 serves as a secondary auxiliary roller (hereinafter referred to as secondary auxiliary roller).

The primary transfer rollers 35Y, 35M, 35C, and 35K are disposed opposite the photosensitive drums 2Y, 2M, 2C, and 2K of the image forming units via the transfer belt 31. The secondary transfer device 36 transfers a composite toner image formed on the transfer belt 31 onto a recording medium supplied from the sheet feed unit 100. The secondary transfer auxiliary roller 33 is disposed inside the loop formed by the transfer belt 31 opposite the secondary transfer roller 36A.

The sheet feed unit 100 stores a stack of recording media in a cassette. The sheet feed unit 100 includes a sheet feed roller 100*a* that picks up a top sheet of the stack of recording media sheets and feeds it to a pair of registration rollers 101. A recording medium being fed by the sheet feed roller 100*a* is stopped temporarily by the pair of registration rollers 101. The pair of registration rollers 101 rotates again in an appropriate timing such that the recording medium is aligned with the toner image formed on transfer belt 31.

A fixing device 90 is disposed downstream from the secondary transfer device 36 in the direction of transport of the recording medium. The fixing device 90 includes a pressing roller 92 and a fixing roller 91 including a heat source. In the fixing device 90, the recording medium bearing the toner image is applied with heat and pressure. Accordingly, the toner image is fixed on the recording medium.

In the image forming units 1Y, 1M, 1C, 1K of the image forming apparatus 10, an electrostatic latent image is formed on each of the photosensitive drums 2Y, 2M, 2C, and 2K by charging the surface thereof by the charger and illuminating the charged surface with a light beam by the image writing unit 80. The electrostatic latent images formed on the photosensitive drums 2Y, 2M, 2C, and 2K are developed with toner by the respective developing device, thereby forming visible images known as toner images. After the developing process, the toner images are transferred from the photosensitive drums 2Y, 2M, 2C, and 2K onto the transfer belt 31 by a transfer bias applied to the primary transfer rollers 35Y, 35M, 35C, and 35K such that they are superimposed one atop the other, thereby forming a composite toner image on the transfer belt 31.

Subsequently, the composite image on the transfer belt 31 is transferred onto the recording medium supplied from the sheet feed unit 100 at the transfer nip at which the transfer belt 31 and the secondary transfer roller 36A of the secondary transfer device 36 meet. More specifically, the composite toner image on the transfer belt 31 is transferred onto the recording medium in the transfer nip due to a transfer electric field generated by the secondary transfer device 36. Subsequently, the recording medium is delivered to the fixing device 90. The composite toner image on the recording medium is fixed by the fixing device 90.

After the toner images are transferred, the photosensitive drums 2Y through 2K are cleaned using a known cleaning method in preparation for the subsequent imaging cycle.

[Embodiment 1]

Figure 4:
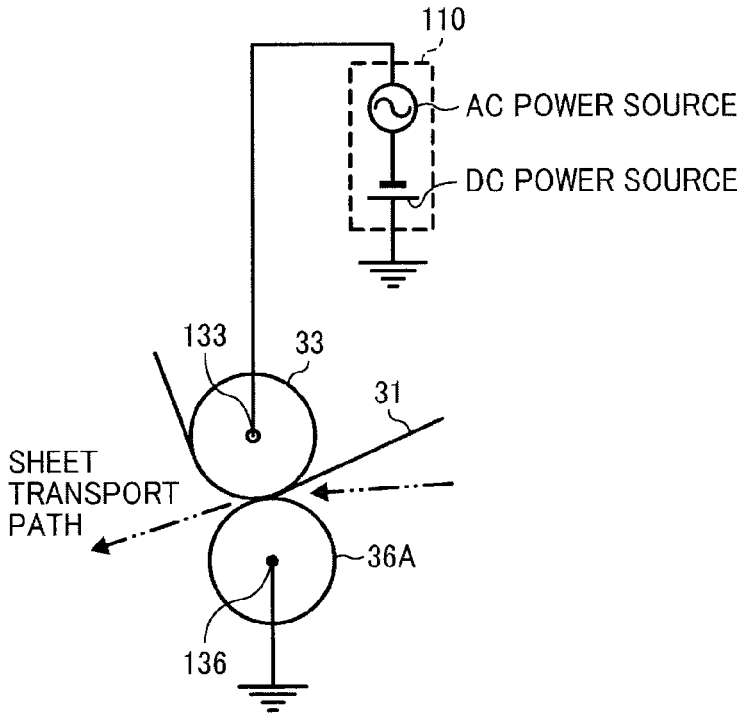
FIG. 4 is a schematic diagram illustrating a transfer device according to a first illustrative embodiment of the present invention.

With reference to FIG. 4, a description is provided of the transfer device employing the secondary transfer device 36 according to a first illustrative embodiment (EMBODIMENT 1) of the present invention. According to the present illustrative embodiment, the secondary transfer device 36 includes the secondary transfer roller 36A facing the transfer auxiliary roller 33 via the transfer belt 31.

As illustrated in FIG. 4, according to the present illustrative embodiment, the superimposed bias power source 110 applies a bias to a cored metal shaft of the transfer auxiliary roller 33 which contacts the inner surface of the transfer belt 31 which is a surface opposite an image bearing surface onto which the toner image is transferred. More specifically, the superimposed bias power source 110 includes the AC power source under constant voltage control and the DC power source under constant current control. The superimposed bias power source 110 applies the transfer auxiliary roller 33 a superimposed bias in which the AC voltage under constant voltage control is superimposed on the DC voltage under constant current control having the same polarity as toner. The superimposed bias is applied to a metal cored bar (electrode) 133 of the transfer auxiliary roller 33 which contacts the inner circumferential surface of the transfer belt 31.

According to the present illustrative embodiment, a transfer speed that is relatively slow refers to a speed approximately 176.4 mm/s. A transfer speed that is relatively fast refers to a speed approximately 352.8 mm/s.

Configurations of the transfer belt 31, the transfer auxiliary roller 33, and the secondary transfer roller 36A are not limited to the configurations described below.

The transfer belt 31 is made of polyimide with a thickness of approximately 60 μm and a surface resistivity in a range of from 10.5 log Ω/□ to 11.5 log Ω/□. The transfer auxiliary roller 33 has a multilayer structure (in this example, two layer-structure) including the metal cored bar and a resistance layer disposed on the metal cored bar. The resistance layer is made of rubber such as a copolymer (ion-conductive) of nitrile butadiene (NBR) and epichlorohydrin (ECO). A front layer of the resistance layer may be made of fluorocarbon resin.

A resistance between a metal surface plate and the transfer auxiliary roller 33 placed on the metal surface plate is in a range of from approximately 6.0 to 7.0 log Ω.

The secondary transfer roller 36A has a three-layer structure including a metal cored bar (electrode) 136, a resistance layer, and a surface layer. The resistance layer is made of rubber such as a copolymer (ion-conductive) of nitrile butadiene (NBR) and epichlorohydrin (ECO). The surface layer is disposed on the resistance layer. The surface layer may be made of fluorocarbon resin.

A resistance between a metal surface plate and the secondary transfer roller 36A placed on the metal surface plate is in a range of from approximately 6.0 log Ω to 7.0 log Ω.

The superimposed bias power source 110 includes the DC power source under constant current control with a maximum output voltage of 10 kV and the AC power source under constant voltage control with a maximum peak-to-peak voltage of 12 kV. An electric circuit of the superimposed power source 110 is connected to the transfer auxiliary roller 33. The secondary transfer roller 36A is grounded. The metal cored bars 133 and 136 of the transfer auxiliary roller 33 and the secondary transfer roller 36A, respectively, serve as electrodes for forming an electric field.

The maximum peak output voltage of the superimposed bias power source 110 is 16 kV which exceeds the leakage limit voltage of 12 kV.

According to the present illustrative embodiment, when using a recording medium with relatively high surface roughness (for example, RECORDING MEDIUM D), the transfer speed is adjusted to a slow transfer speed. By contrast, when using a recording medium having either a surface with high smoothness (for example, RECORDING MEDIUM A) or a surface with low smoothness (for example, RECORDING MEDIUM B), the transfer speed is adjusted to a fast transfer speed.

The transfer speed is adjusted using a controller 700 such as a Central Processing Unit (CPU) shown in FIG. 7. Based on the surface information provided by the control panel 600 or the surface condition detector 102, the transfer speed, that is, the speed of transferring the toner image from the intermediate transfer belt onto the recording medium is adjusted. More specifically, based on the surface roughness of the recording medium provided by the control panel 600 or the surface condition detector 102, the controller 700 adjusts the linear velocity of the photosensitive drum and the intermediate transfer belt 31, and a sheet delivery speed of the registration rollers 101. Furthermore, the controller 700 adjusts the oscillating electric field.

Alternatively, when using the recording medium with relatively high surface roughness (for example, RECORDING MEDIUM D), the transfer speed is adjusted to a slow transfer speed. In a case in which the recording medium has a surface with high smoothness or low smoothness, the transfer speed is adjusted to either a slow transfer speed or a fast transfer speed depending on the thickness of the recording medium.

A description is now provided of an example of a setting of the transfer bias and the transfer speed when using the following sample recording media.

A sample recording medium of A3-size ZANDERS ZETA hammer white (manufactured by M-real Zanders GmbH) having a rough surface (with high surface roughness and low surface roughness) is used. The basis weight thereof is approximately 260 gsm. Another sample recording medium is an A3-size My Paper (manufactured by NBS Ricoh Company Ltd) having a surface with low smoothness. The basis weight thereof is approximately 67 gsm (smoothness: 45 s). An image is output at 10° C., 15% humidity. A solid blue image is formed on an entire surface of the recording medium in a single-side printing mode. According to the present illustrative embodiment, in the superimposed transfer mode in which an alternating current has a sine wave, positive charge toner used, and the toner is transferred by applying positive polarity from the transfer auxiliary roller 33.

Figure 10:
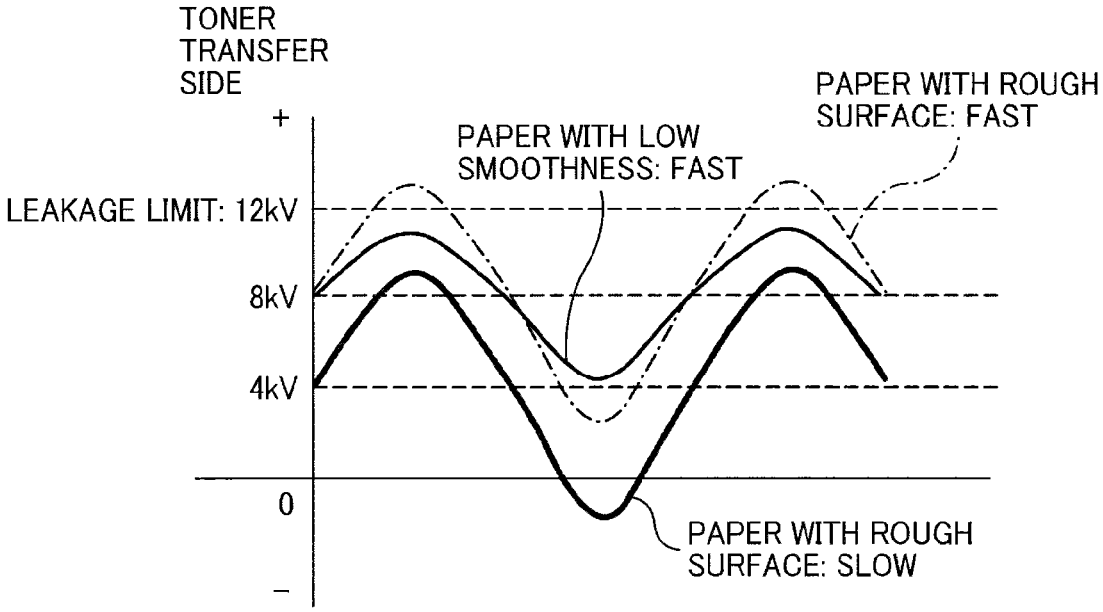
FIG. 10 is a graph showing a relation of leakage and transfer bias conditions according to an illustrative embodiment of the present invention.

With reference to TABLE 1 and FIG. 10, a description is provided of the relation of leakage and a setting of the DC and the AC power sources in the above conditions.

According to experiments performed by the present inventors, a constant current setting (TABLE 1: DC (μA)) of the DC power source for both the recording medium having a rough surface and the recording medium with low smoothness was 70 μA at the fast transfer speed and 35 μA at the slow transfer speed. In a low-temperature, low-humidity environment, the resistance of the rollers and the recording medium increased. As a result, the DC voltage (TABLE 1: DC (kV)) was 8 kV at the fast transfer speed and 4 kV at the slow transfer speed.

A constant voltage setting (TABLE 1: AC (kVpp)) of the AC power source was 10 kVpp for the recording medium having a rough surface, and 6 kVpp for the recording medium with low smoothness. Since the fast transfer speed was approximately twice as fast as the slow transfer speed, the same level of AC voltage was employed at both fast and slow transfer speeds as described above.

TABLE 1

| SHEET | TRANSFER SPEED | DC (μA) | DC (kV) | AC (kVpp) | Peak Voltage (kV) | LEAKAGE |
|---|---|---|---|---|---|---|
| ZETA hammer white | FAST | 70 | 8 | 10 | 13 | YES |
| ZETA hammer white | SLOW | 35 | 4 | 10 | 9 | NO |
| My Paper | FAST | 70 | 8 | 6 | 11 | NO |

When the transfer speed was fast, the peak voltage was 13 kV for the recording medium of Zeta Hammer White having a rough surface, which exceeded the leakage limit of 12 kV. As a result, leakage occurred, and hence white spots (partial absence of toner) were generated in the resulting image.

By contrast, in the case of My Paper with low smoothness, the peak voltage was 11 kV which was below the leakage limit. Accordingly, no image defect occurred.

By reducing the transfer speed when using a recording medium having a rough surface, the output of the DC power source can be low. In view of the above, the peak voltage for the recording medium having a rough surface was reduced to 9 kV. With this configuration, the peak voltage was prevented from exceeding the leakage limit, hence preventing image defects.

As described above, in a case in which the oscillating electric field is strong, leakage can be prevented by reducing the transfer speed.

[Embodiment 2]

Figure 5:
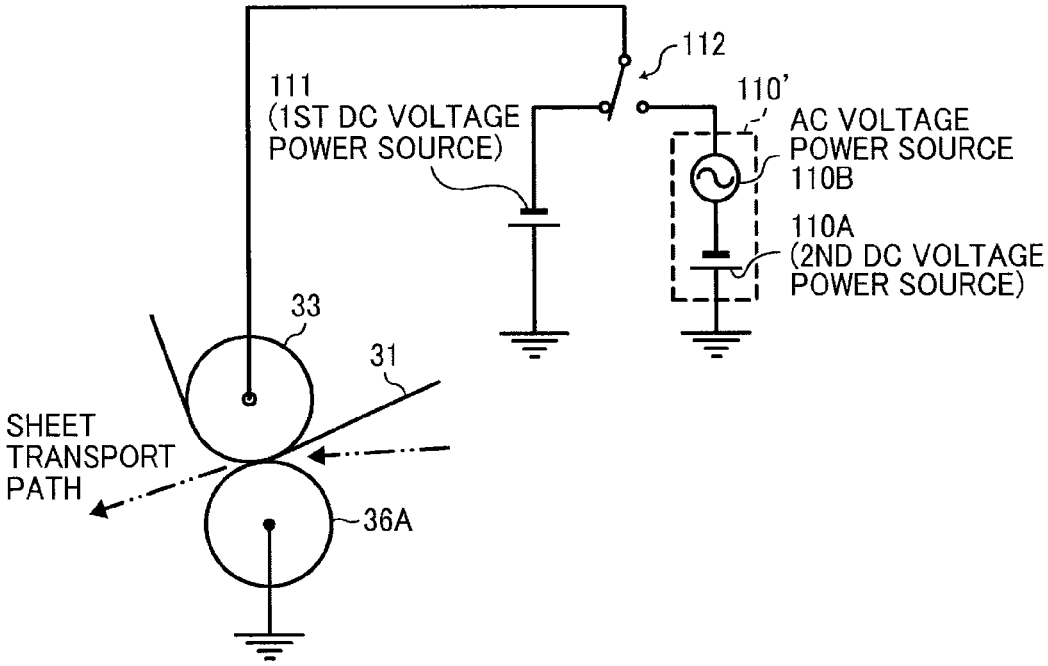
FIG. 5 is a schematic diagram illustrating a transfer device according to a second illustrative embodiment of the present invention.

With reference to FIG. 5, a description is provided of a second illustrative embodiment (EMBODIMENT 2). According to the present illustrative embodiment, the configuration of the power source is different from that of EMBODIMENT 1.

According to the present illustrative embodiment, a first DC power source 111 is under constant current control, and the maximum output voltage thereof is 10 kV and does not exceed the leakage limit of approximately 12 kV.

A superimposed bias power source 110' includes a second DC power source 110A and an AC power source 110B. The second DC power source 110A is under constant current control, and the maximum output voltage thereof is 5 kV. The AC power source 110B is under constant voltage control, and the maximum output peak-to-peak voltage is 10 kV.

As the superimposed bias power source, the maximum peak voltage is 10 kV. Thus, the maximum output voltage of the AC power source 110B is configured to be less than the leakage limit of 12 kV.

According to the present illustrative embodiment, a relay 112 is provided to switch a feed line between the metal cored bar of the transfer auxiliary roller 33, and one of the first DC power source 111 and the superimposed power source 110'.

With this configuration, when using a recording medium having a rough surface (with high surface roughness), the relay 112 is switched to the superimposed bias power source 110' so that the superimposed bias power source 110' is used, and the transfer speed is adjusted to be slow.

By contrast, when using a recording medium with either high smoothness or low smoothness, the relay 112 is switched to the second DC power source 110A, and the transfer speed is adjusted to be fast. Alternatively, when using the recording medium having a rough surface (with high surface roughness), the relay 112 is switched to the superimposed bias power source 110', and the transfer speed is adjusted to be slow. When using the recording medium with either high smoothness or low smoothness, the relay 112 is switched to the second DC power source 110A, and the transfer speed is adjusted to be either slow or fast in accordance with the thickness of the recording medium.

[Embodiment 3]

Figure 6:
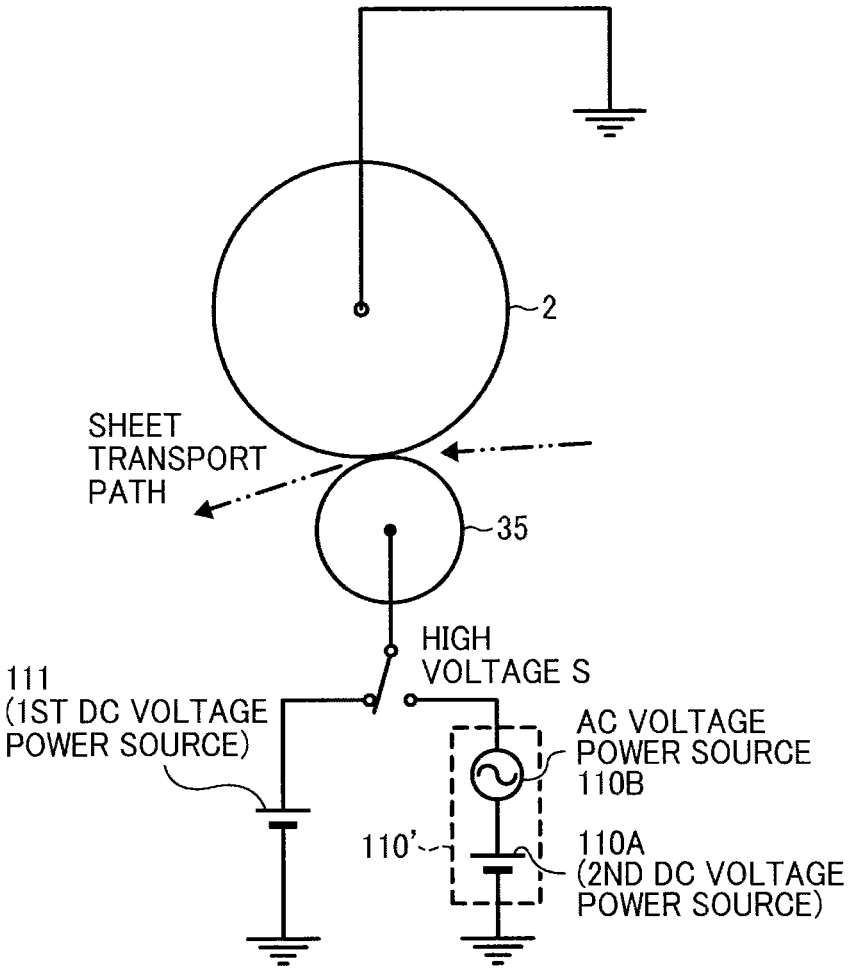
FIG. 6 is a schematic diagram illustrating a transfer device according to a third illustrative embodiment of the present invention.

With reference to FIG. 6, a description is provided of a third illustrative embodiment of the present invention (EMBODIMENT 3). According to the present illustrative embodiment, the superimposed power source 110' of the Embodiment 2 is employed to form a transfer electric field between the photosensitive drum 2 serving as an image bearing member, instead of the transfer belt 31, and the primary transfer roller 35 to transfer the toner image on the photosensitive drum 2 directly onto the recording medium. It is to be noted that suffixes Y, M, C, and K indicating the colors yellow, magenta, cyan, and black are omitted, unless otherwise specified.

The photosensitive drum 2 includes an aluminum base on which a photosensitive layer is laminated. The primary transfer roller 35 has a two-layer structure including a metal cored bar and a resistance layer. The resistance layer is made of rubber such as a copolymer (ion-conductive) of nitrile butadiene (NBR) and epichlorohydrin (ECO). The resistance between a metal surface plate and the metal cored bar of the primary transfer roller 35 placed on the metal surface plate is in a range of from approximately 7.5 log Ω to approximately 8.0 log Ω.

According to the present illustrative embodiment, use of the power sources and the transfer speed setting is the same as the Embodiment 2.

With reference to FIGS. 11 through 15, a description is provided of variations of the transfer mechanism. It is to be noted that the same reference numerals used in the foregoing illustrative embodiments will be given to constituent elements such as parts and materials having the same functions, and the descriptions thereof will be omitted.

Figure 11:
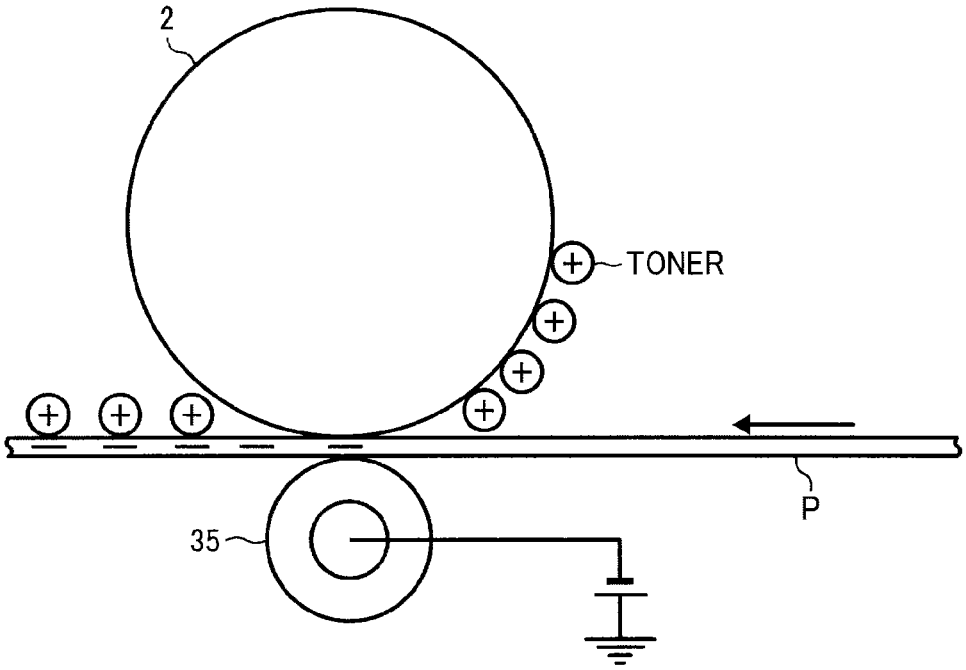
FIG. 11 is a schematic diagram illustrating a first variation of the transfer device employed in the image forming apparatus according to an illustrative embodiment of the present invention.

FIG. 11 is a schematic diagram illustrating a first variation of the transfer mechanism. In this variation, the toner image is transferred directly from the photosensitive drum 2 to the recording medium. As illustrated in FIG. 11, the transfer roller 35 having a medium resistance connected to a DC power source is disposed opposite the photosensitive drum 2 and applies a transfer bias to the photosensitive drum 2. The transfer roller 35 employs a roller including a conductive core portion using a foaming agent or a roller coated with a coating layer.

Figure 12:
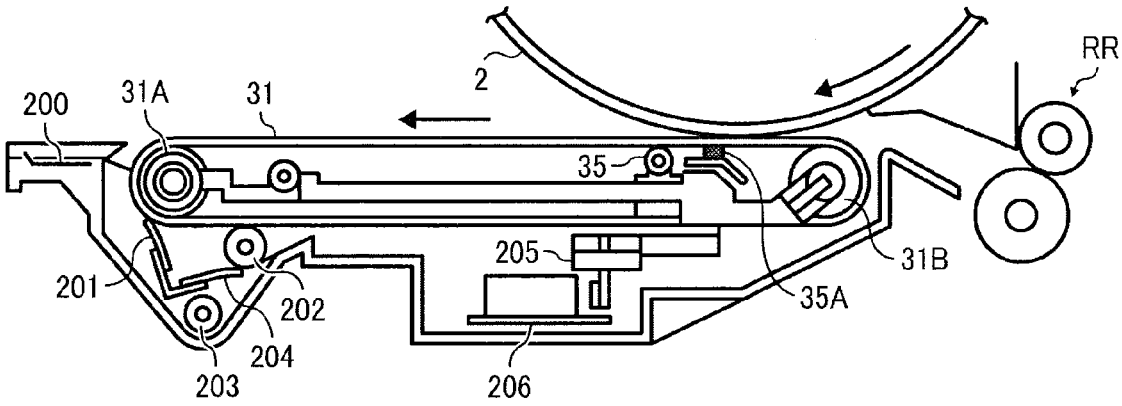
FIG. 12 is a schematic diagram illustrating a second variation of the transfer device employed in the image forming apparatus according to an illustrative embodiment of the present invention.

FIG. 12 is a schematic diagram illustrating a second variation of a transfer mechanism in which the toner image borne on the photosensitive drum 2 is transferred onto the transfer belt 31 serving as a transfer member. In this example, the transfer belt 31 has a medium resistance. The transfer belt 31 is formed into a loop and entrained about a drive roller 31A and a driven roller 31B, thereby rotating in the direction of arrow in FIG. 12.

The transfer roller 35 and a bias brush 35A serving as transfer members for transferring the toner image onto a recording medium are disposed inside the looped transfer belt 31 opposite the photosensitive drum 2. The bias brush 35A applies a bias to the transfer belt 31 to absorb the recording medium electrostatically to the transfer belt 31. The transfer roller 35 applies a bias to attract the toner image borne on the photosensitive drum 2 to the recording medium. The bias applied by the transfer roller 35 includes a superimposed bias.

After the transfer process, a charge eliminator 200 removes residual charge on the transfer belt 31 while a cleaning blade 201 removes residual toner thereon. A cleaning bias roller 202 contacts the transfer belt 31 to remove residual toner remaining on the transfer belt 31. A toner recovery coil 203 collects the removed toner and supplies the toner to the developing device. A bias roller blade 204 contacts the cleaning bias roller 202 to remove the residual toner from the cleaning bias roller 202 towards the toner recovery coil 203.

As illustrated in FIG. 12, a lever 205 is provided to move the transfer belt 31 to contact and separate from the photosensitive drum 2. In an image forming apparatus equipped with a plurality of image forming units, the lever 205 is employed to move the transfer belt 31 to contact the respective photosensitive drum 2. A transfer power source 206 for the transfer process supplies power to the transfer roller 35. In FIG. 12, reference letters RR refer to a pair of registration rollers.

Figure 13:
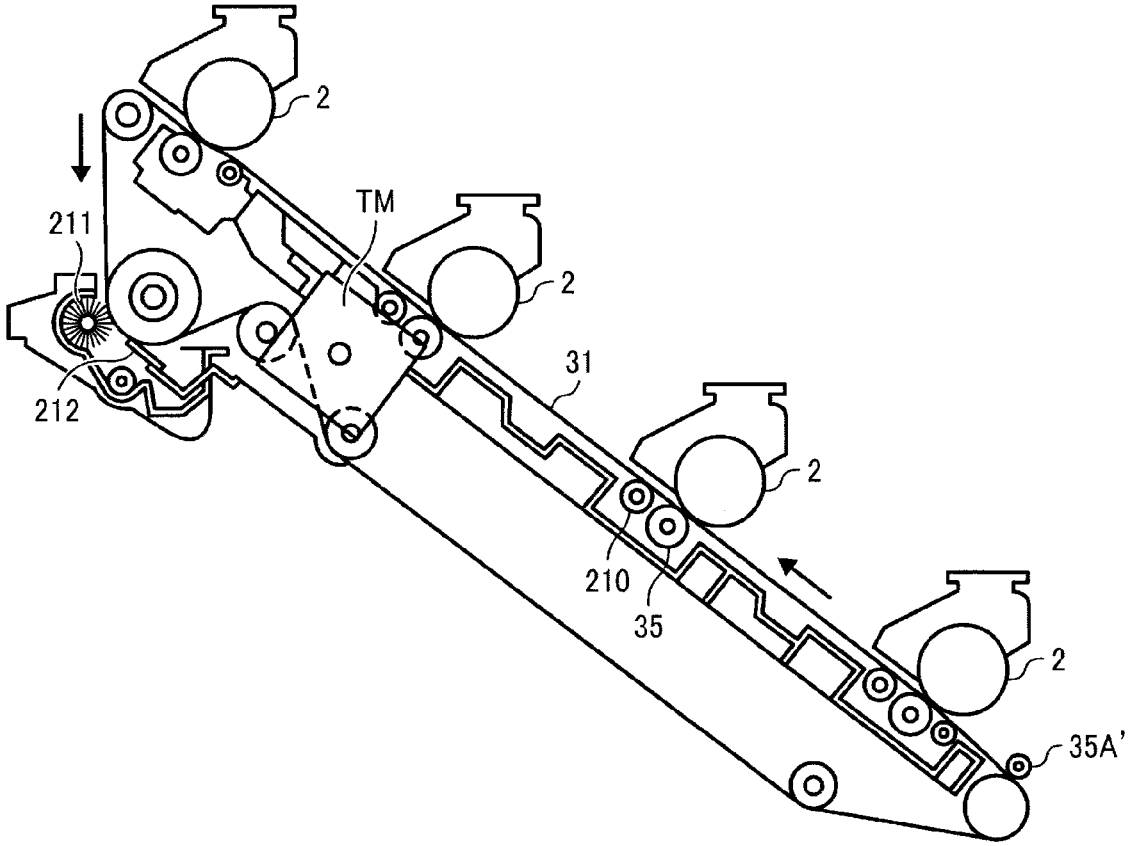
FIG. 13 is a schematic diagram illustrating a third variation of the transfer device employed in the image forming apparatus according to an illustrative embodiment of the present invention.

FIG. 13 is a schematic diagram illustrating a third variation of the transfer mechanism in which the outer loop of the transfer belt 31 of FIG. 12 faces the plurality of photosensitive drums 2, and the toner images formed on the photosensitive drums 2 are transferred onto the transfer belt 31 such that they are superimposed one atop the other.

The transfer roller 35 and an auxiliary roller 210 are disposed opposite each of the photosensitive drums 2 via the transfer belt 31. A sheet suction roller 35A' contacts the transfer belt 31 and applies a bias thereto to electrostatically absorb the recording medium to the transfer belt 31. In the transfer mechanism shown in FIG. 13, after the transfer process, a brush roller 211 and a cleaning blade 212 remove residual toner remaining on the transfer belt 31.

Figure 14:
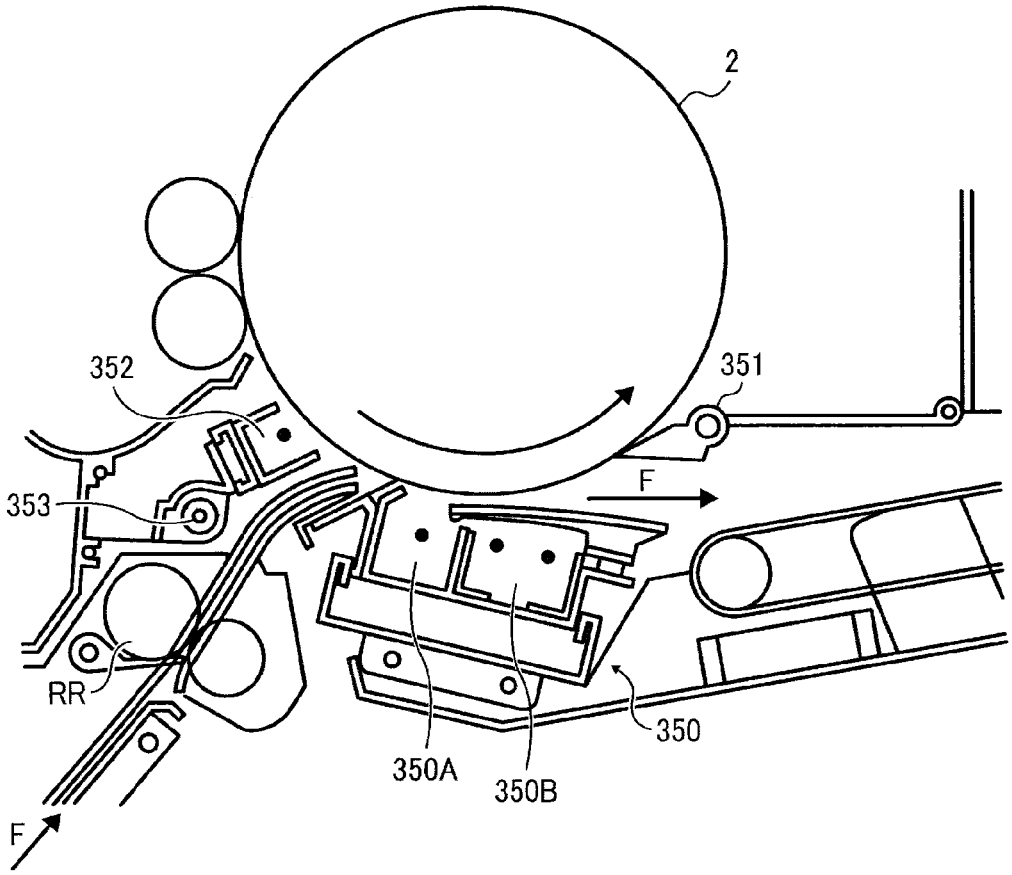
FIG. 14 is a schematic diagram illustrating a fourth variation of the transfer device employed in the image forming apparatus according to an illustrative embodiment of the present invention.

FIG. 14 is a schematic diagram illustrating a fourth variation of the transfer mechanism in which the toner image is transferred directly from the photosensitive drum 2 to a recording medium, similar to the variation shown in FIG. 11. In FIG. 14, a charger 350, instead of a roller, is employed as a transfer member disposed opposite the photosensitive drum 2. The charger 350 includes a transfer charger 350A and a separation charger 350B disposed near the transfer charger 350A.

A bias that neutralizes electrostatic attraction between the recording medium and the photosensitive drum 2 after the transfer process is applied to the separation charger 350B. In this configuration, the recording medium being delivered in the direction of arrow F is separated from the photosensitive drum 2 by a separation claw 351.

According to the present illustrative embodiment, a pre-transfer charger 352 charges uniformly the surface of the photosensitive drum 2 before the transfer process. Flashing a pre-transfer charge eliminating lamp 353 adjusts the potential of a non-image formation area of the photosensitive drum 2, thereby enhancing transfer efficiency of the toner image.

Figure 15:
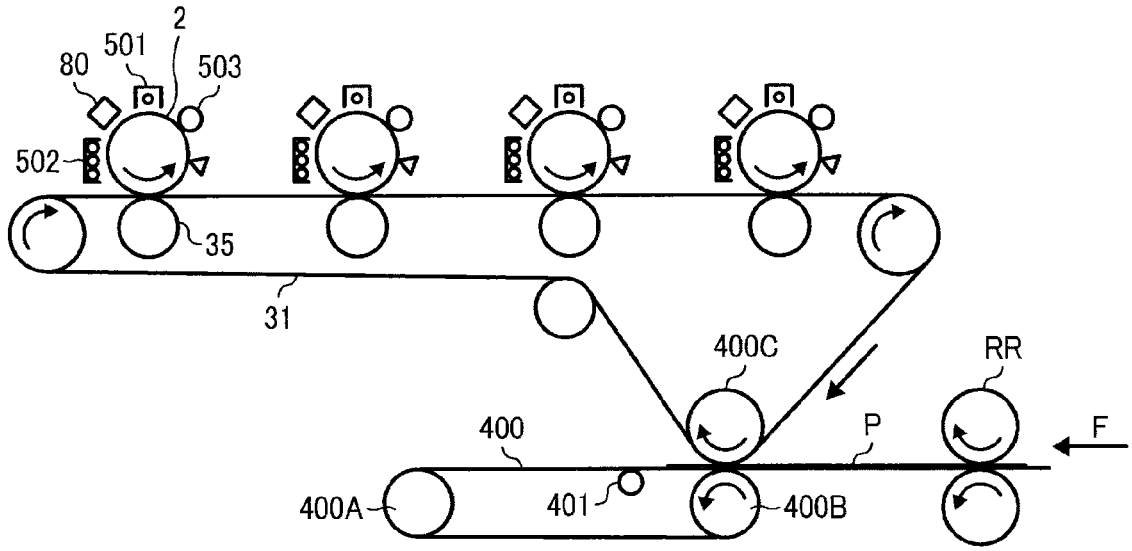
FIG. 15 is a schematic diagram illustrating a fifth variation of the transfer device employed in the image forming apparatus according to an illustrative embodiment of the present invention.

FIG. 15 is a schematic diagram illustrating a fifth variation of the transfer mechanism. According to the present illustrative embodiment, the transfer mechanism includes the plurality of the photosensitive drums 2, the intermediate transfer belt 31, and a secondary transfer belt 400 serving as a secondary transfer device that transfers a composite toner image formed on the intermediate transfer belt 31 onto a recording medium.

The transfer rollers 35 are disposed opposite the photosensitive drums 2 via the intermediate transfer belt 31. Inside the loop formed by the secondary transfer belt 400, a secondary transfer roller 401 is disposed near a contact position at which the secondary transfer belt 400 contacts the intermediate transfer belt 31. The secondary transfer belt 400 is entrained about a drive roller 400A and a follower roller 400B. An auxiliary roller 400C is disposed inside the looped intermediate transfer belt 31 opposite the follower roller 400B.

Each of the photoconductive drums 2 are disposed in a process cartridge provided for each color. Imaging devices such as a charging device 501, the image writing device 80, a developing device 502, and a cleaning device 503 are disposed around each of the photosensitive drums 2 in a casing of the process cartridges.

According to the foregoing illustrative embodiments and variations, an optimum transfer electric field is reliably obtained regardless of surface conditions of a recording medium by adjusting the transfer speed in accordance with surface roughness and/or smoothness of the recording medium in addition to reducing a peak voltage of the transfer voltage below the leakage limit voltage. With this configuration, even when the peak voltage rises high, leakage is prevented.

Furthermore, the superimposed bias has a waveform in which a transfer polarity for transferring the toner image onto a recording medium and a polarity opposite that of the transfer polarity are alternately inverted. With this configuration, transferability of toner relative to a recording medium having high surface roughness can be enhanced while suppressing the peak voltage.

According to an aspect of this disclosure, the present invention is employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image bearing member that bears a toner image;

a transfer member that forms a transfer nip between the image bearing member and the transfer member;

a power source that outputs any one of a DC transfer voltage and a superimposed transfer voltage in which an AC voltage is superimposed on a DC voltage to transfer the toner image from the image bearing member onto a recording sheet at the transfer nip; and a controller that controls the power source and changes a transfer speed for transferring the toner image onto the recording sheet, wherein the power source is controlled by the controller to output the DC transfer voltage and the transfer speed is set to a first velocity when the recording sheet has a first surface roughness, the power source is controlled by the controller to output the superimposed transfer voltage and the transfer speed is set to a second velocity that is slower than the first velocity when the recording sheet has a second surface roughness that is larger than the first surface roughness, and a peak voltage of the superimposed transfer voltage is larger than the DC transfer voltage.

2. The image forming apparatus according to claim 1, further comprising:

a surface condition detector to detect a surface condition of the recording sheet, wherein in a case in which the surface condition of the recording sheet detected by the surface condition detector is more rough than a predetermined value, the intensity of the oscillating electric field formed by the superimposed transfer voltage is increased and the maximum transfer speed is reduced.

3. The image forming apparatus according to claim 1, wherein the DC voltage is under constant current control and the AC voltage is under constant voltage control.

4. The image forming apparatus according to claim 1, wherein the superimposed transfer voltage has a waveform in which a first polarity for transferring the toner to the recording sheet and a second polarity opposite the first polarity are alternately inverted.

5. The image forming apparatus, according to claim 1, wherein a time averaged value (Vave) of the superimposed transfer voltage has a polarity in a transfer direction of toner from the image bearing member to the recording medium and is at the transfer direction side beyond a center value (Voff) between a maximum value and a minimum value of the superimposed transfer voltage.

6. The image forming apparatus according to claim 1, wherein:

the image bearing member is an intermediate transfer member, and one of the first electrode and the second electrode is a metal core of a transfer roller that contacts a surface of the recording sheet opposite a surface onto which the toner image is transferred, and another of the first electrode and the second electrode is an auxiliary roller that contacts a surface of the intermediate transfer member opposite an image bearing surface that bears the toner image.

7. The image forming apparatus according to claim 1, further comprising:

a first electrode; and a second electrode disposed opposite the first electrode with the image bearing member interposed therebetween to form the DC transfer voltage and the superimposed transfer voltage.

8. The image forming apparatus according to claim 7, wherein:

one of the first electrode and the second electrode is connected to the power source, and another of the first electrode and the second electrode is grounded.

* * * * *